US005599089A

United States Patent [19]

Sheu et al.

[11] Patent Number: 5,599,089

[45] Date of Patent: Feb. 4, 1997

[54] LIGHT DEVICE WITH EXTENSIBLE AND RETRACTABLE BULB UNIT

[76] Inventors: Tyng-Jen Sheu; Jia-Ming Sheu, both of No. 12, Alley 25, Lane 254, Shan-Chiao Rd., Niao-Sung Hsiang, Kaohsiung Hsien, Taiwan

[21] Appl. No.: 600,517

[22] Filed: Feb. 13, 1996

[51] Int. Cl.[6] ..... F21L 15/00

[52] U.S. Cl. ..... 362/198; 362/250; 362/287; 362/426; 362/427

[58] Field of Search ..... 362/250, 285, 362/287, 418, 419, 426, 427, 429, 198

[56] References Cited

U.S. PATENT DOCUMENTS

| | | | |
|---|---|---|---|
| 3,519,812 | 7/1970 | Brindley et al. | 362/198 |
| 4,443,831 | 4/1984 | Godfrey et al. | 362/198 X |
| 4,870,543 | 9/1989 | Born et al. | 362/198 X |

*Primary Examiner*—Stephen F. Husar
*Attorney, Agent, or Firm*—Christensen O'Connor Johnson & Kindness PLLC

[57] ABSTRACT

A light device includes a casing, a bulb holding rod, a bulb unit, a power supply unit, a guide device, and a retainer device. The casing includes a bulb receiving recess formed in an external surface thereof, and a slide hole formed in the casing. The holding rod is mounted slidably within the slide hole of the casing and has an inner end located in the casing, and an outer end which extends from the slide hole. The bulb unit is carried pivotally on the outer end of the rod. The power supply unit is installed within the casing and is connected electrically to the bulb unit so as to energize the bulb unit when in use. The guide device prevents rotation of the rod within the slide hole of the casing. The retainer device prevents disengagement of the rod from the slide hole of the casing.

4 Claims, 6 Drawing Sheets

LIGHT DEVICE WITH EXTENSIBLE AND RETRACTABLE BULB UNIT

BACKGROUND OF THE INVENTION

1. Field of the Invention

The invention relates to a light device, more particularly to a light device with an extensible and retractable bulb unit.

2. Description of the Related Art

Referring to FIG. 1, a conventional light device 1, such as one used to illuminate automatically a room in case of electrical breakdown, includes a casing 10, a pair of bulb holding seats 102, two bulb units 14, and a power supply unit (not visible) disposed in the casing 10.

As illustrated, the casing 10 has a handle 100 for carrying the same. The seats 102 are secured on the upper portion of the casing 10. Each of the bulb units 14 has two lugs 140 respectively disposed on both sides of the corresponding seat 102. A locking bolt 16 extends through the holes in the lugs 140 and the seat 102 for connection with a nut 18.

A drawback of the aforesaid light device resides in that the bulb units 14 cannot be retracted into the casing 10, thereby resulting in occupation of storage space and inconveniencing transport thereof.

SUMMARY OF THE INVENTION

The object of this invention is to provide a light device which includes an extensible and retractable bulb unit such that the bulb unit can be retracted in order to assist in storage and transport.

Accordingly, the light device of this invention includes a casing, a bulb holding rod, a bulb unit, a power supply unit, a guide device, and a retainer device. The casing includes a bulb receiving recess formed in an external surface thereof, and a slide hole formed in the casing. The holding rod is mounted slidably within the slide hole of the casing and has an inner end located in the casing, and an outer end which extends from the slide hole. The bulb unit is carried on the outer end of the rod. The power supply unit is installed within the casing and connected electrically to the bulb unit so as to energize the bulb unit when in use. The guide device prevents rotation of the rod within the slide hole of the casing. The retainer device prevents disengagement of the rod from the slide hole of the casing.

In use, the majority of the rod is exposed to an exterior of the casing. When the rod is retracted into the slide hole of the casing, the bulb unit moves into the recess of the casing. This facilitates the storage or transport of the light device of this invention.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
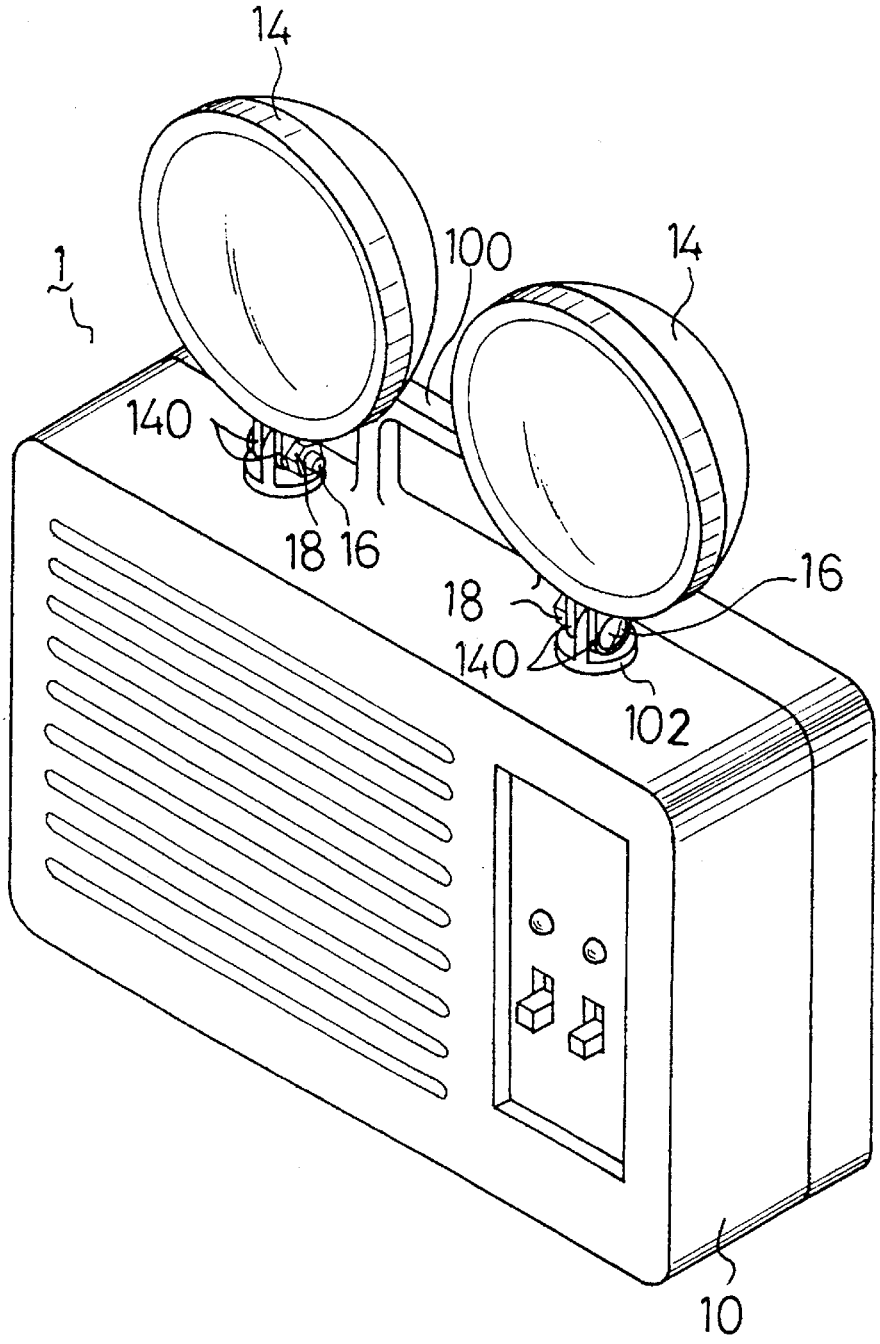
FIG. 1 PRIOR ART
FIG. 1 is a perspective view of a conventional light device.
Figure 2:
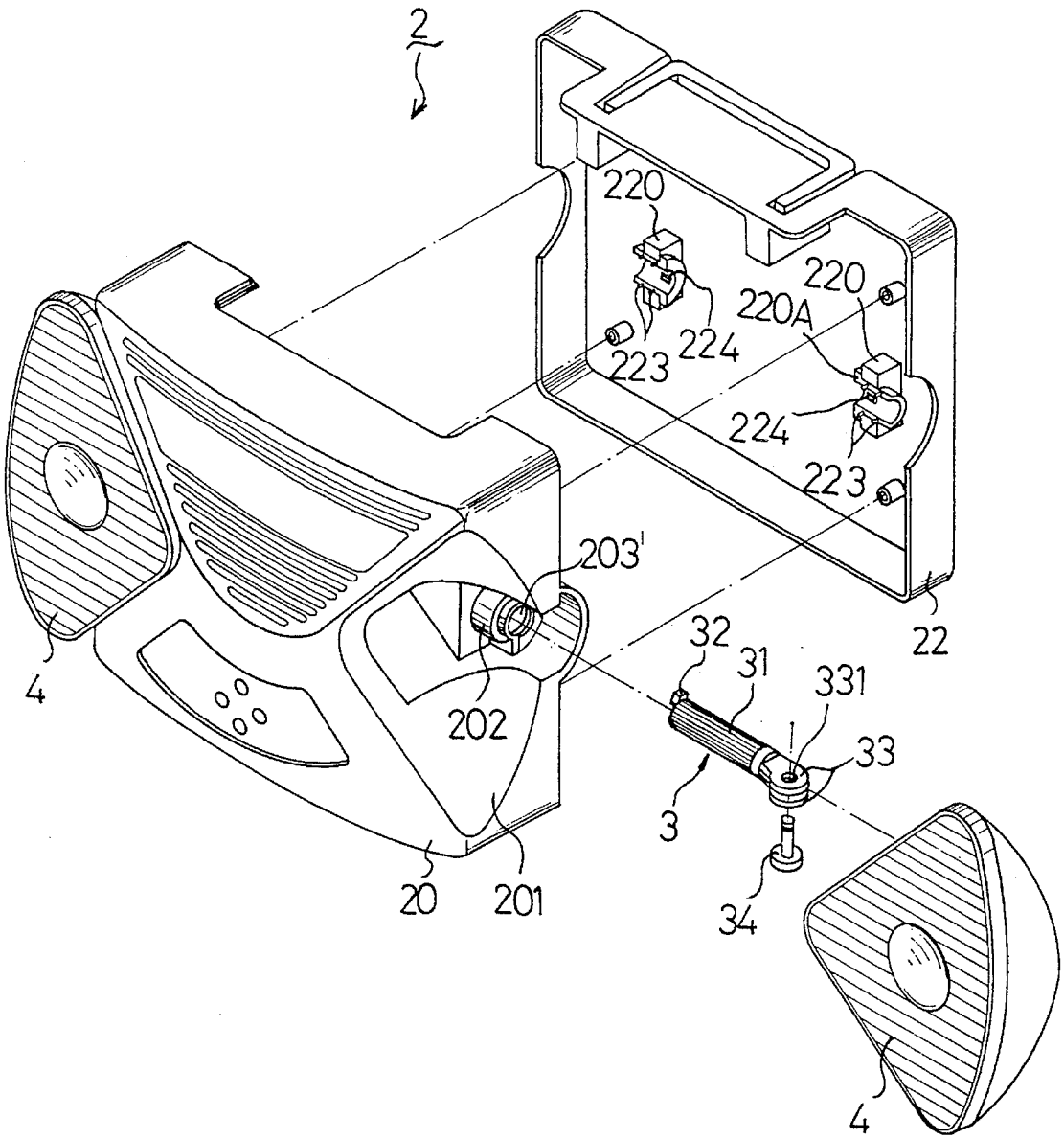
FIG. 2 is an exploded view of a preferred embodiment of a light device of this invention.
Figure 3:
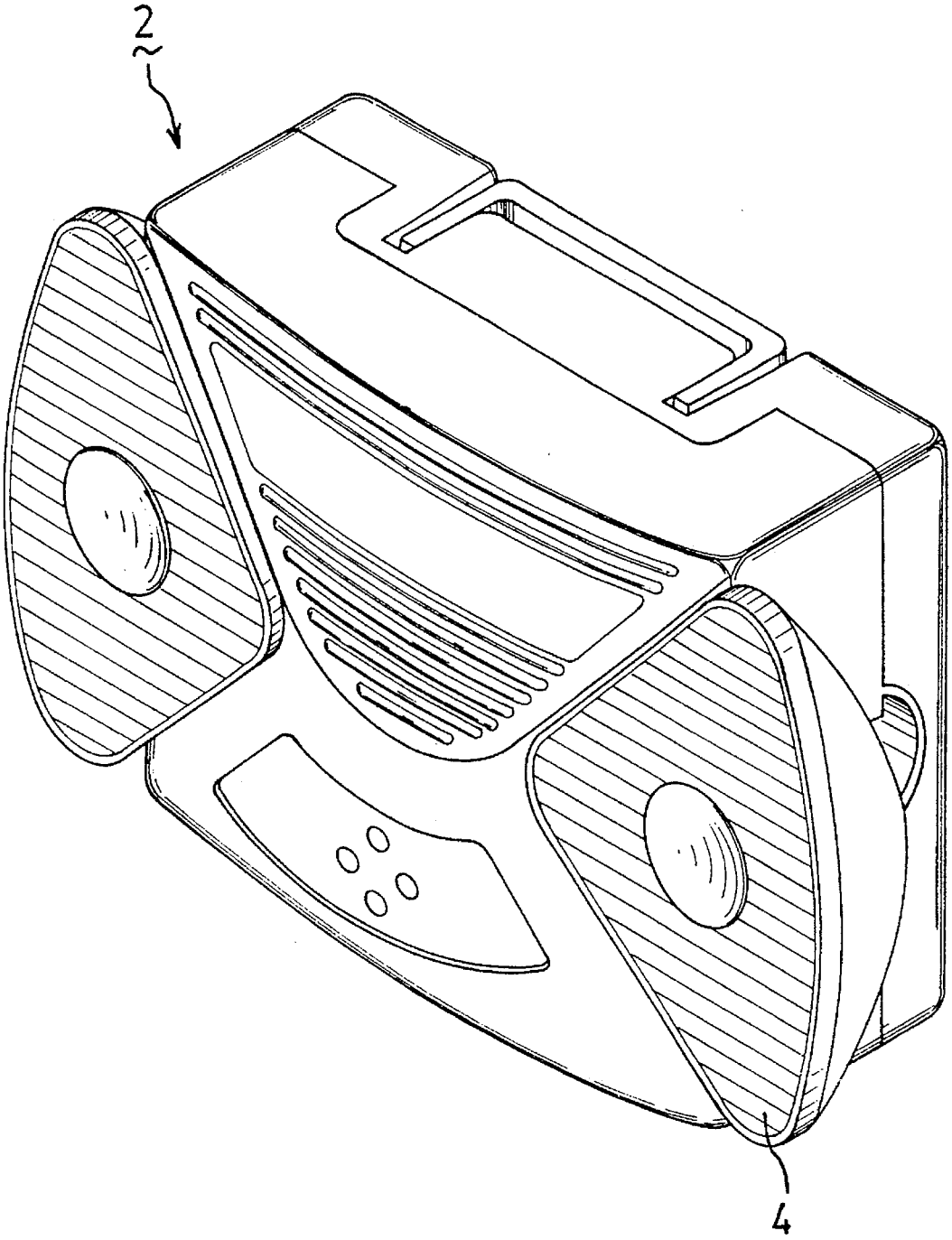
FIG. 3 is a perspective view of the preferred embodiment of this invention.

Referring to FIGS. 2 and 3, the light device of this invention includes an insulated casing 2, a pair of bulb holding rods 3, a pair of bulb units 4, a power supply unit (not visible), a guide device, and a retainer device.

Figure 4:
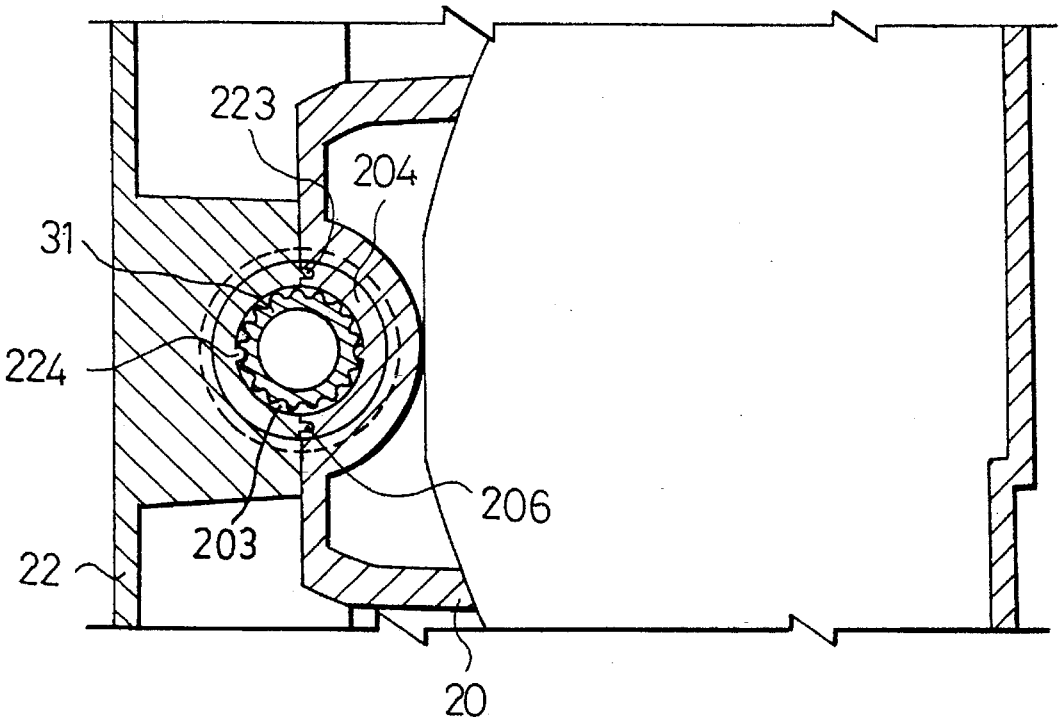
FIG. 4 is a sectional view of a portion of a casing employed in the preferred embodiment.

As illustrated, the casing 2 includes front and rear casing halves 20, 22 each of which is formed with an integral half-hole member 220 of a semi-circular cross-section. The members 220 are coupled together so as to constitute the casing 2 in such a manner that the half-hole members 220 cooperatively define two slide holes 203 (see FIG. 4) formed in the casing 2 at two opposite sides thereof, and two integral tubular seats 202 located in the recess 201 formed in an external surface of the front half 20. Each of the seats 202 defines a slide bore 203' communicated with one of the slide holes 203 (see FIG. 4). The power supply unit, such as dry cells or a rechargeable battery, is disposed in the casing 2.

Each of the rods 3 is mounted slidably within the corresponding slide hole 203 (see FIG. 4) of the casing 2 and has an inner end located in the casing 2, and an outer end which extends from the slide bore 203'. A plurality of axially extending slots 31 are formed in an external surface of the rod 3. A retainer protrusion 32 projects radially and outwardly from the inner end of the rod 3. The outer end of the rod 3 includes two aligned integral lugs 33 which respectively have a pair of aligned holes 331 formed therethrough.

Figure 5:
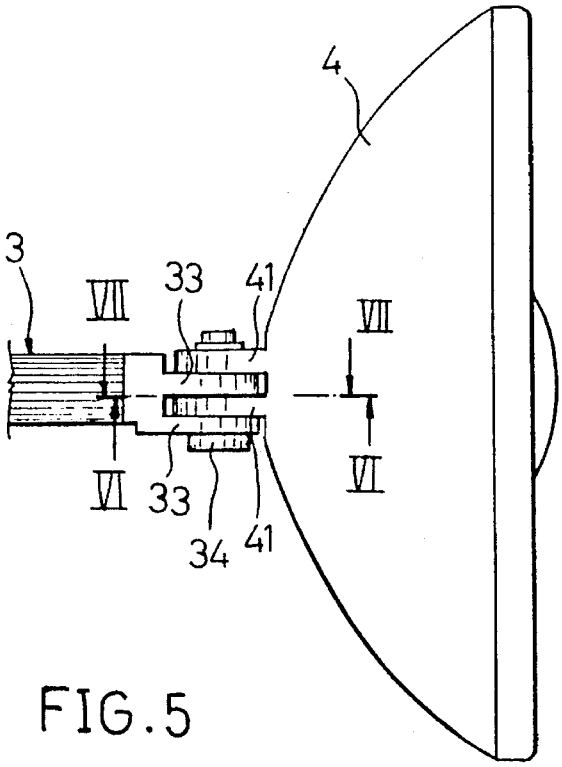
FIG. 5 illustrates how a bulb unit is mounted on a holding rod in the preferred embodiment.
Figure 6:
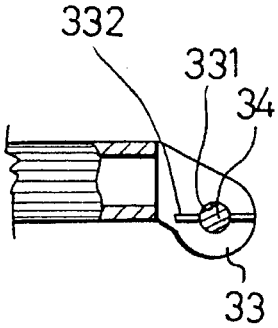
FIG. 6 is a sectional view of the rod taken along line VI—VI of FIG. 5.

As shown in FIGS. 5 and 6, each of the bulb units 4 has two fixed ears 41 with two aligned holes formed therethrough. A pivot pin 34 extends through the holes 331 of the lugs 33 and the holes of the ears 41 of corresponding bulb unit 4 so that the bulb unit 4 can pivot about the pivot pin 34. The bulb units 4 are electrically connected to the power supply unit.

Referring again to FIGS. 2 and 4, the half-hole members 220 of the casing 2 have interengaging surfaces 220A. One of the half-hole members 220 is formed with four positioning holes 206, while the other one of the half-hole members 220 includes four posts 223 projecting into the positioning holes 206 (see FIG. 4) respectively so as to interconnect and position the half-hole members 220 relative to each other. Each of the half-hole members 220 further includes a guide device, such as a guide protrusion 224 which projects radially and inwardly to engage one of the slots 31 of the rod 3 so as to prevent rotation of the rod 3 within the slide hole 203 (see FIG. 4) of the casing 2. Each of the rods 3 can slide in the corresponding slide hole 203 (see FIG. 4) of the casing 2 between a retracted position, wherein the bulb unit 4 is located within the recess 201, and an extended position, wherein the retainer protrusion 32 of the rod 3 contacts an end surface of one of the half-hole members 220 in order to prevent separation of the rod 3 from the half-hole members 220. The retainer protrusion 32 serves as a retainer device in this preferred embodiment. When storing or transporting the light device of this invention, the rods 3 can be retracted into the casing 2 so as to save space.

Figure 7:
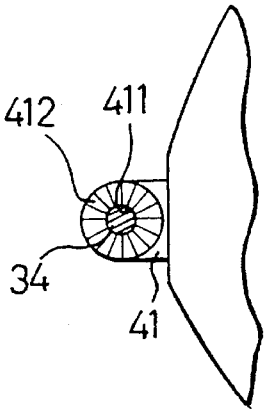
FIG. 7 is a sectional view of the bulb unit taken along line VII—VII of FIG. 5.

As shown in FIG. 7, one of the ears 41 has a plurality of radially extending slots 411 which are formed in the inner surface thereof and which define a plurality of radially extending projections 412. As shown in FIG. 6, one of the lugs 33 includes two radially extending ribs 332 projecting from the inner surface thereof to engage two of the slots 411 so as to position the lugs 33 on the ears 41.

Figure 8:
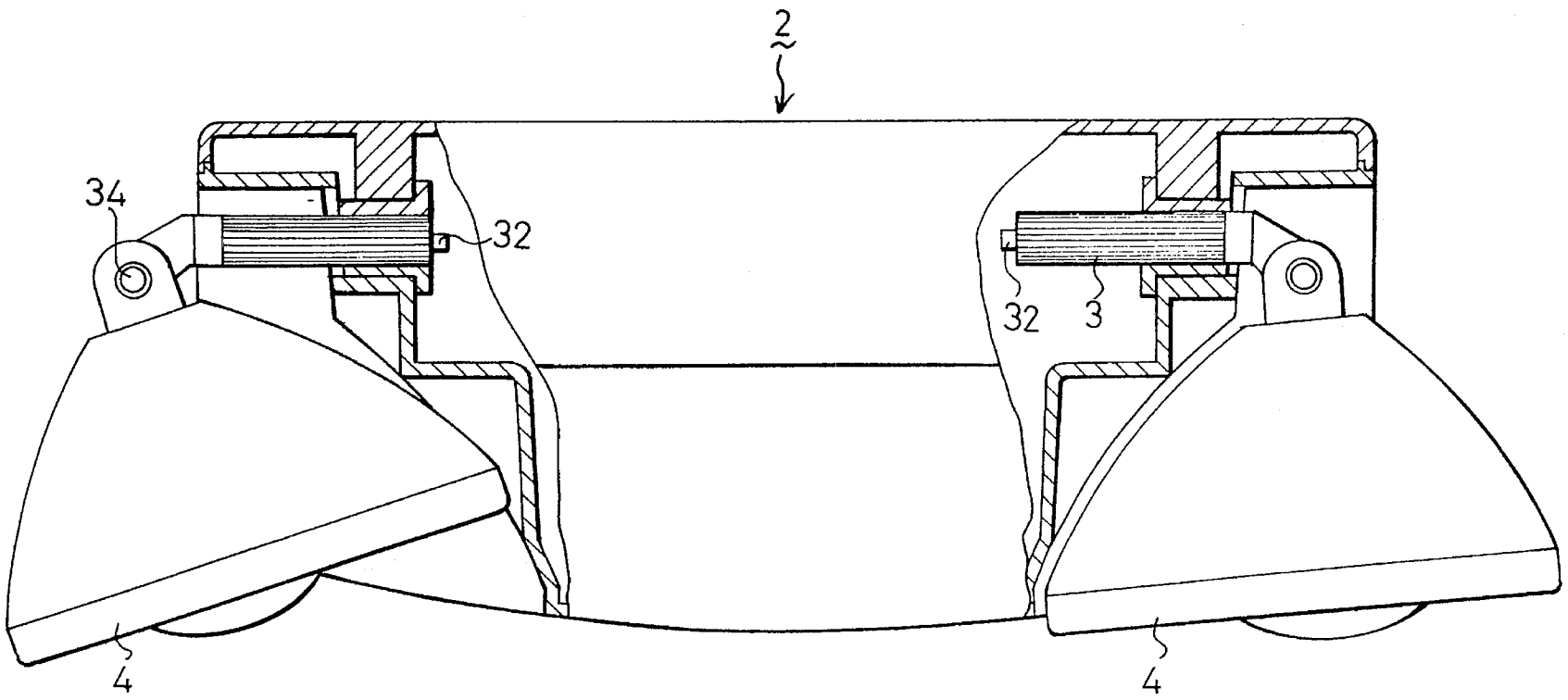
FIG. 8 illustrates how a bulb unit pivots in the preferred embodiment.

FIG. 8 illustrates the light device of this invention when in use. As shown, the majority of one of the rods 3 is exposed to an exterior of the casing 2. The left bulb unit 4 is pivoted about the pin 34 by an angle.

With this invention thus explained, it is obvious to those skilled in the art that various modifications and variations can be made without departing from the scope and spirit thereof. It is therefore intended that this invention be limited only as in the appended claims.

We claim:

1. A light device comprising:

a casing which has a bulb receiving recess formed in an external surface thereof, and a slide hole formed in said casing, and which is adapted to mount a power supply unit therein;

a bulb holding rod mounted slidably within said slide hole of said casing and having an inner end located in said casing, and an outer end extending from said slide hole, majority of said rod being exposed to an exterior of said casing when said device is in use;

a bulb unit carried on the outer end of said rod and being movable into said recess of said casing when said rod is retracted into said slide hole for storage purposes, said bulb unit being adapted to be connected electrically to said power supply unit so as to be energized by said power supply unit in use;

a power supply unit installed within said casing and connected electrically to said bulb unit so as to energize said bulb unit when in use;

a guide device for preventing rotation of said rod within said slide hole of said casing; and a retainer device for preventing disengagement of said rod from said slide hole of said casing.

2. The light device as defined in claim 1, wherein said casing includes two casing halves each of which is formed with an integral half-hole member of a semi-circular cross-section, said casing halves being coupled together in such a manner that said half-hole members cooperatively define said slide hole therebetween, said rod extending through said slide hole and having a plurality of axially extending slots formed in an external surface thereof, and a retainer protrusion projecting radially and outwardly from the inner end of said rod, said rod being slidable in said slide hole between a retracted position, wherein said bulb unit is located within said recess, and an extended position, wherein said retainer protrusion of said rod contacts an end surface of one of said half-hole members in order to prevent separation of said rod from said half-hole members, one of said half-hole members having a guide protrusion projecting radially and inwardly therefrom to engage one of said slots of said rod so as to prevent rotation of said rod within said slide hole of said casing.

3. A light device as claimed in claim 2, wherein one of said half-hole members has four positioning holes formed therein, the other one of said half-hole members having four posts projecting therefrom into said positioning holes respectively so as to interconnect and position said half-hole members relative to each other.

4. The light device as claimed in claim 1, wherein the outer end of said rod has two aligned integral lugs respectively provided with a pair of aligned holes that are formed through said lugs, said bulb unit having two fixed ears with two aligned holes formed therethrough, said rod further having a pivot pin that extends through said holes of said lugs and said holes of said ears so that said bulb unit can pivot about said pivot pin.

* * * * *